US008035658B2

(12) United States Patent
Matsuyama

(10) Patent No.: US 8,035,658 B2
(45) Date of Patent: Oct. 11, 2011

(54) BIFOCAL DISPLAY DEVICE AND BIFOCAL DISPLAY METHOD

(75) Inventor: Motohiro Matsuyama, Tachikawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 12/826,379

(22) Filed: Jun. 29, 2010

(65) Prior Publication Data

US 2010/0328350 A1 Dec. 30, 2010

(30) Foreign Application Priority Data

Jun. 30, 2009 (JP) ..... 2009-156274

(51) Int. Cl.
*G09G 5/00* (2006.01)

(52) U.S. Cl. ..... 345/629; 345/634

(58) Field of Classification Search ..... 345/629, 345/634

See application file for complete search history.

(56) References Cited

U.S. PATENT DOCUMENTS

| | | | | |
|---|---|---|---|---|
| 6,552,734 | B1 * | 4/2003 | Rozin | 345/629 |
| 2003/0035591 | A1 * | 2/2003 | Crabtree | 382/254 |
| 2008/0023546 | A1 * | 1/2008 | Myodo et al. | 235/462.04 |

FOREIGN PATENT DOCUMENTS

| | | |
|---|---|---|
| JP | 10-083465 | 3/1998 |
| JP | 2003-131607 | 5/2003 |
| JP | 2008-058982 | 3/2008 |
| JP | 2008-145540 | 6/2008 |
| JP | 2008-310269 | 12/2008 |

OTHER PUBLICATIONS

Japanese Patent Application No. 2009-156274; Notice of Reasons for Rejection; Mailed Nov. 2, 2010 (English Translation).

* cited by examiner

*Primary Examiner* — Jeffery A Brier

(74) *Attorney, Agent, or Firm* — Blakely, Sokoloff, Taylor & Zafman LLP

(57) ABSTRACT

According to one embodiment, there is provided a bifocal display device includes a database that manages at least distant and nearby viewpoint images as data files, an image processing circuit that obtains a far viewpoint image and a nearby viewpoint image from the data base, blurs contours of the far viewpoint image, emphasizes contours of the nearby viewpoint image, and performs an image processing of superimposing the blurred far viewpoint image and the emphasized nearby viewpoint image on each other, and a display that displays a result of the image processing.

8 Claims, 4 Drawing Sheets

BIFOCAL DISPLAY DEVICE AND BIFOCAL DISPLAY METHOD

CROSS-REFERENCE TO RELATED APPLICATIONS

This application is based upon and claims the benefit of priority from Japanese Patent Application No. 2009-156274, filed Jun. 30, 2009; the entire contents of which are incorporated herein by reference.

FIELD

Embodiments described herein relate generally to a bifocal display device and a bifocal display method which display various items of information for distant and nearby observers.

BACKGROUND

In recent years, the scale of flat-screen displays has become greater and greater, allowing use as bulletin boards and signboards providing a large number of observers with various items of information content. Conventionally, there has been proposed a display device provided with a display area for nearby observers and another display area for distant observers. The display area for distant observers is designed to be larger than the other display area for nearby observers. In this display device, both display areas are switched between each other in accordance with a result of detecting relative position and distance of an observer in relation to the display.

However, the conventional display device gives rise to difficulties in switching the display areas when there are a large number of observers. In addition, this display device is not intended to simultaneously display different items of information content to an unspecified large number of observers.

BRIEF DESCRIPTION OF THE DRAWINGS

A general architecture that implements the various feature of the embodiments will now be described with reference to the drawings. The drawings and the associated descriptions are provided to illustrate the embodiments and not to limit the scope of the invention.

DETAILED DESCRIPTION

Figure 1:
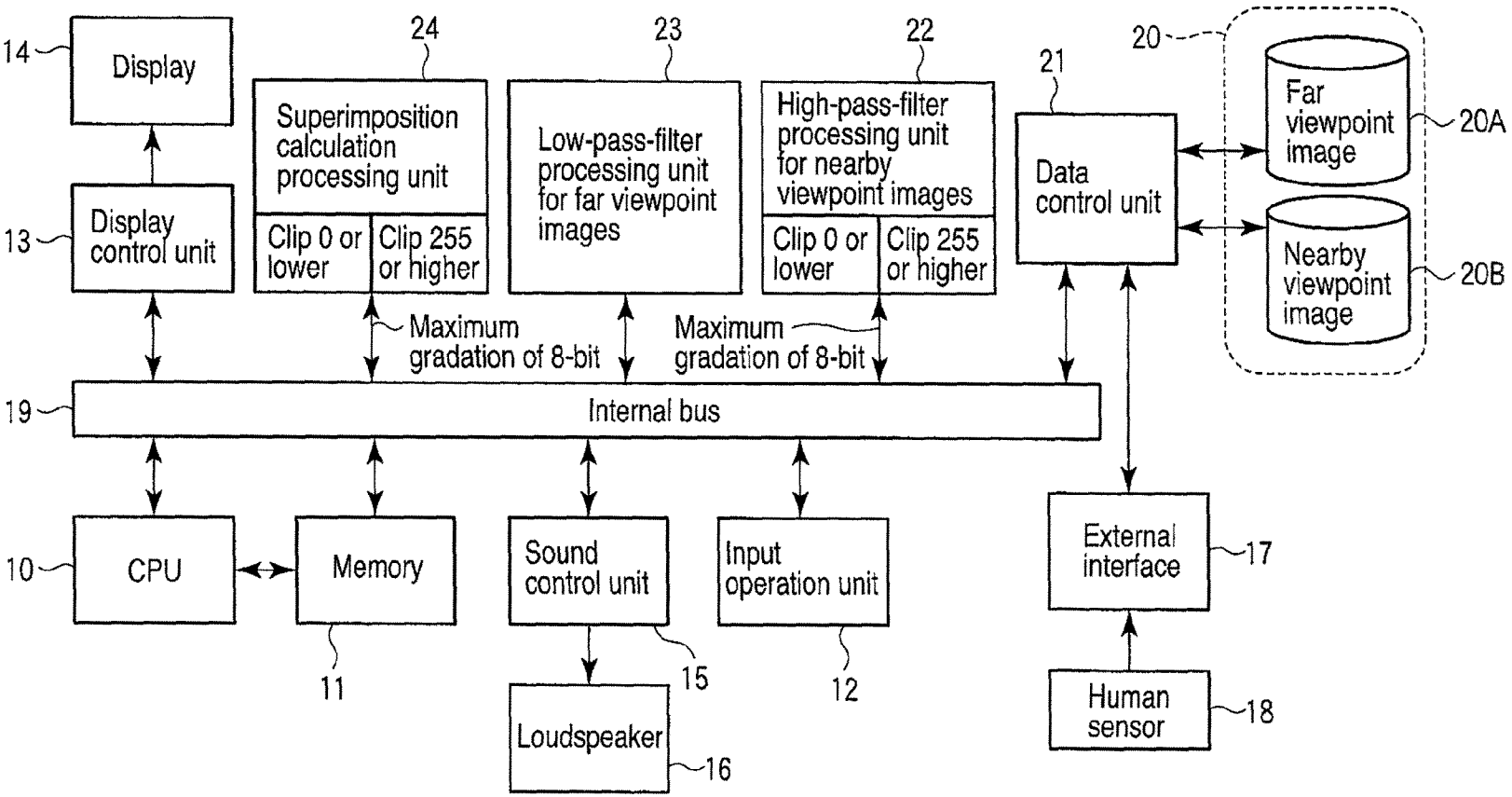
FIG. 1 is a block diagram schematically representing an example configuration of a bifocal display device according to an embodiment of the invention.

Various embodiments will be described hereinafter with reference to the accompanying drawings.

In general, according to one embodiment, there is provided a bifocal display device comprising: a database that manages at least distant and nearby viewpoint images as data files; an image processing circuit that obtains a far viewpoint image and a nearby viewpoint image from the data base, blurs contours of the far viewpoint image, emphasizes contours of the nearby viewpoint image, and performs an image processing of superimposing the blurred far viewpoint image and the emphasized nearby viewpoint image on each other; and a display that displays a result of the image processing.

According to another aspect of the invention, there is provided a bifocal display method comprising: managing at least distant and nearby viewpoint images as data files; obtaining a far viewpoint image and a nearby viewpoint image from the database; blurring contours of the far viewpoint image, emphasizing contours of the nearby viewpoint image, and performing an image processing of superimposing the blurred far viewpoint image and the emphasized nearby viewpoint image on each other; and displaying a result of the image processing.

According to the bifocal display device and bifocal display method described above, a far viewpoint image and a nearby viewpoint image are obtained, and then, contours of the far viewpoint image are blurred while contours of the nearby viewpoint image are emphasized. Further, the distant and nearby viewpoint images are superimposed on each other.

The nearby viewpoint image may be constituted by text or graphic having a size capable of providing nearby observers with a large quantity of information. The far viewpoint image may be constituted by text or graphic having a size capable of providing distant observers with a small quantity of information. Principally by the human visual sense, details of a distant image can not clearly be recognized while details of a nearby image can be recognized clearly. By employing this principle, contours of a far viewpoint image, i.e., contours of text and/or graphic having a large size are blurred to reduce visual recognizability for nearby observers, and contours of a nearby viewpoint image, i.e., contours of text and/or graphic having a small size are emphasized to enhance visual recognizability for nearby observers. Accordingly, even when a far viewpoint image and a nearby viewpoint image are superimposed on each other, information of the far viewpoint image can be provided for distant observers, excluding influence from the nearby viewpoint image, and information of the nearby viewpoint image can be provided for nearby observers, excluding influence from the far viewpoint image. As a result, different items of information content respectively corresponding to different distances to an unspecified large number of observers can be displayed simultaneously, without requiring switching images.

Hereinafter, a bifocal display device according to an embodiment of the invention will be described with reference to the accompanying drawings.

FIG. 1 schematically represents an example configuration of the bifocal display device. The bifocal display device comprises: a CPU 10 which controls operation of the entire device; a memory 11 which holds a control program, setting data, and input/output data for the CPU 10; an input operation unit 12 which inputs commands and data to the CPU 10 finally; a display control unit 13 which controls display operation of displaying images; a display 14 which displays images under control of the display control unit 13; a sound control unit 15 which controls output operation of outputting sounds corresponding to images displayed on the display 14; a loudspeaker 16 which outputs sounds under control of the sound control unit 15; an external interface 17 for connecting an external device; and a human sensor 18 which is connected as an external device to the external interface 17. The CPU 10 is directly connected to the memory 11, and is further connected to the internal bus 19. Thru the internal bus 19, the CPU 10 also connected to the input operation unit 12, display control unit 13, and sound control unit 15.

Further, the bifocal display device comprises: a database 20 which manages, as data files, at least a far viewpoint image 20A and a nearby viewpoint image 20B; a data control unit 21 which accesses the far viewpoint image and nearby viewpoint image stored in the database 20 through an independent bus; a high-pass-filter processing unit 22 for nearby viewpoint images, which emphasizes contours of a nearby viewpoint image obtained from the database 20; a low-pass-filter processing unit 23 for far viewpoint images, which blurs contours of a far viewpoint image obtained from the database 20; and a superimposition calculation processing unit 24 which superimposes the nearby viewpoint image and far viewpoint image obtained as processing results from the processing units 22 and 23. Through an internal bus 19, the CPU 10 is also connected to the data control unit 21, high-pass filter processing unit 22, low-pass-filter processing unit 23, and superimposition calculation processing unit 24. The data control unit 21 is connected not only to the database 20 but also to the external interface 17. The high-pass filter processing unit 22 for nearby viewpoint images and the superimposition calculation processing unit 24 are provide with a gradation clip circuit for gradation values not higher than zero and another gradation clip circuit for gradation values not lower than 255. The low-pass-filter processing unit 23 for far viewpoint images has a coefficient sum division function which is applied to pixel gradation values as an image processing result.

The database 20 is provided with storage 20A for far viewpoint images and storage 20B for nearby viewpoint images. For example, a nearby viewpoint image is stored in storage 20B, as a data file along with a sound associated with the image. A nearby viewpoint image includes one or both of text and graphic within a size capable of providing nearby observers with a large quantity of information. A far viewpoint image is to surely provide distant observers with a small quantity of information, and includes text or graphic having a size which is bigger than the size of the text and/or graphic of the nearby viewpoint image.

Figure 2:
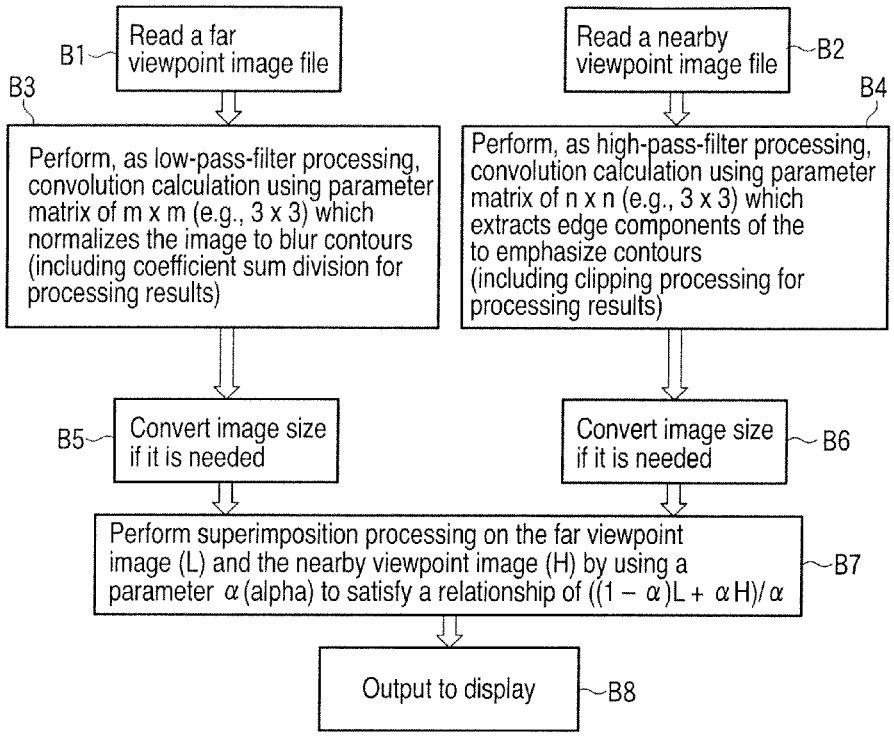
FIG. 2 is a flowchart representing an image processing performed by the bifocal display device represented in FIG. 1.

FIG. 2 represents an image processing flowchart which performed by the bifocal display device represented in FIG. 1. In this image processing, the data control unit 21 reads far/distant and nearby viewpoint images from the database 20 in parallel through blocks B1 and B2. In block B3, the low-pass-filter processing unit 23 performs, as a low-pass-filter processing on the far viewpoint image, a convolution calculation using a parameter matrix of m×m (for example, 3×3) which smoothes the image to blur contours. A range of gradation values which are obtained as a processing result is normalized by coefficient sum division. In block B4, the high-pass filter processing unit 22 performs, as a high-pass filter processing, a convolution calculation using a parameter matrix of n×n (for example, 3×3) by which edge components of an image are extracted to emphasize contours. In this processing, each matrix coefficients are set to take a sum of zero in order to emphasize contours. The values which are neither smaller than zero nor more than 256 are clipped in order that pixel gradation values as a processing result fall within a range of 8 bits, that is from 0 to 255. In blocks B5 and B6, if it is needed, the superimposition calculation processing unit 24 converts the sizes of a far viewpoint image obtained from the low-pass-filter processing unit 23 and a nearby viewpoint image obtained from the high-pass filter processing unit 22 into particular sizes, respectively. Subsequently in block B7, the superimposition calculation processing unit 24 performs a superimposition processing on the far viewpoint image (L) and the nearby viewpoint image (H) by using a parameter $\alpha$ to satisfy a relationship of $((1-\alpha)L+\alpha H)/\alpha$. In block B8, an image as a processing result is output to the display 14 thru the display control unit 13. Furthermore, the values which are neither smaller than zero nor more than 256 are clipped in order that pixel gradation values as a processing result fall within a range of 8 bits, that is from 0 to 255. Alternatively, the image processing result from the superimposition calculation processing unit 24 may be output to still another display device through the external interface 17 under control of the CPU 10. The high-pass-filter processing unit 22 and the low-pass-filter processing unit 23 process only gradation of luminance components of respective pixels which constitute the nearby or far viewpoint image while color components thereof are maintained intact.

When the human sensor 18 detects an observer who has come up close to the display 14 (e.g., an observer as a display target for whom a nearby viewpoint image is to be displayed), the CPU 10 may then change the display position and/or display content of a nearby viewpoint image (text and/or graphic) by using the database 20. Further, in accordance with a change to the display content of the nearby viewpoint image, the CPU 10 may change sound messages or may output particular sounds which indicate the change of the display content.

Figure 3:
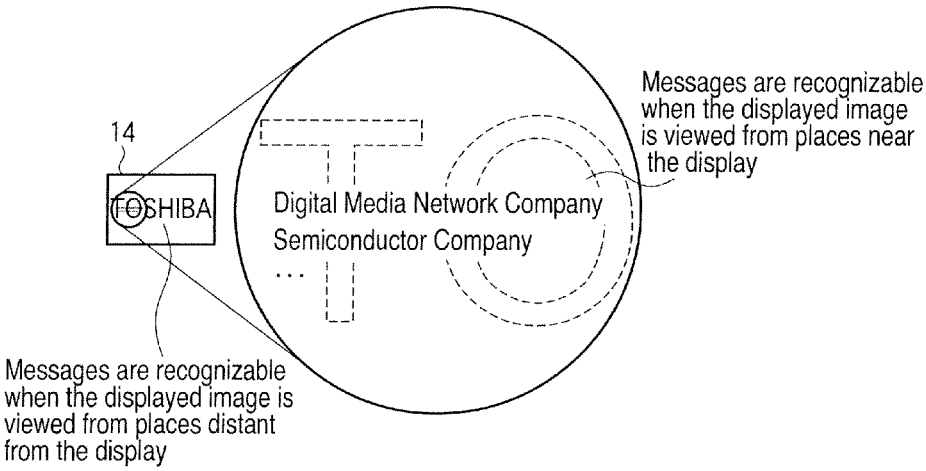
FIG. 3 represents the image figure of this patent's effect. There are two kind messages which are provided respectively for observers who are distant and close to an image displayed as a result of the image processing represented in FIG. 2.

FIG. 3 represents messages as a result of the image processing represented in FIG. 2, which are displayed respectively for observers distant from an image and for nearby observers close to an image. Distant observers recognize a message "TOSHIBA" from an image displayed on the display 14. On the other side, nearby observers recognize a message "Digital Media Network Company, . . . ,". At this time, none of the distant and nearby observers substantially recognizes the message which is recognized by the other of the distant and nearby observers.

Figure 4:
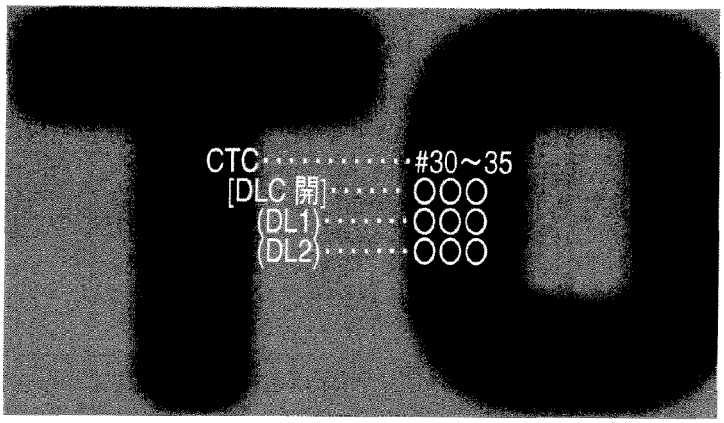
FIG. 4 represents an example of an image which is simulated by a calculator and is to be displayed as a result of the image processing represented in FIG. 2.

FIG. 4 partially represents an example of an image which is simulated by a calculator and is to be displayed as a result of the image processing represented in FIG. 2. Apparently from FIG. 4, contours of large text characters are blurred while contours of small text characters are emphasized clearly.

Figure 5:
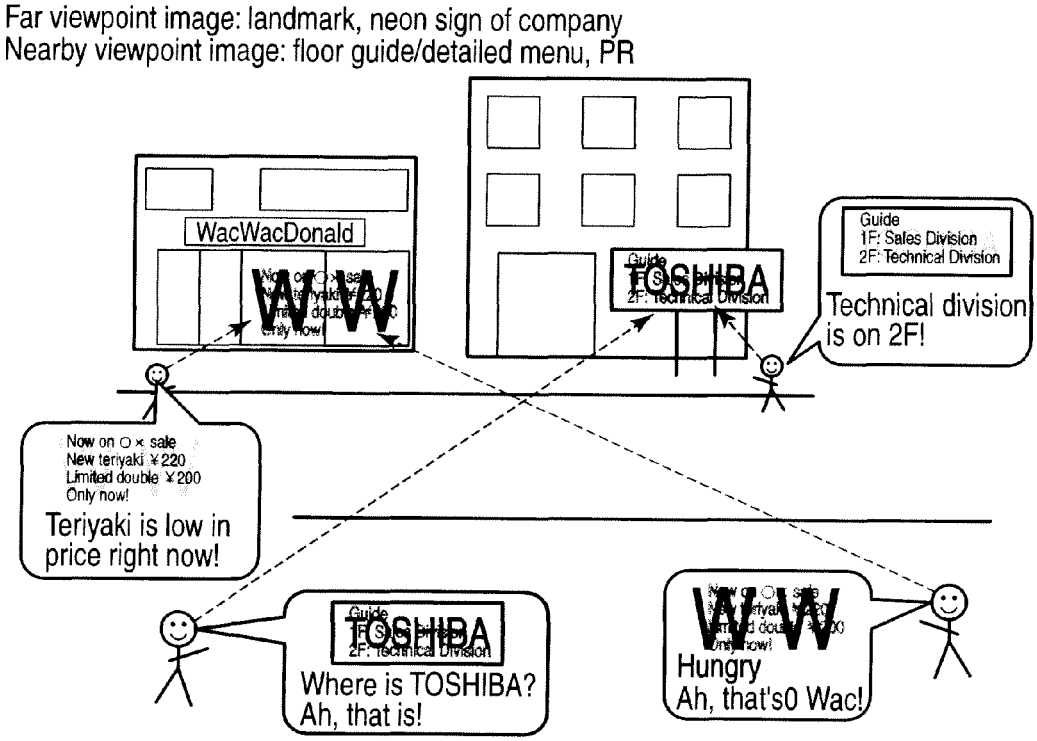
FIG. 5 represents a first application example of the bifocal display device represented in FIG. 1.

FIG. 5 represents a first application example of the bifocal display device. In this example, bifocal display devices are applied as displays constructed adjacent to buildings in FIG. 5. An image displayed on the display adjacent to the building on the right side provides distant observers with information like a neon sign or a land mark of a company ("TOSHIBA" in this case), and also provides nearby observers with information like a floor guide. An image displayed on the other display built in a window glass of a restaurant in the left side provides distant observers with information like a trademark of the restaurant ("WW" in this case), and also provides nearby observers with information concerning articles for special sale or a menu of new articles. Conventionally, such two different types of information content need to be displayed in respectively different display areas or by switching different images in one overlapping display area. However, in this application example, messages for distant and nearby observers can be presented simultaneously.

Figure 6:
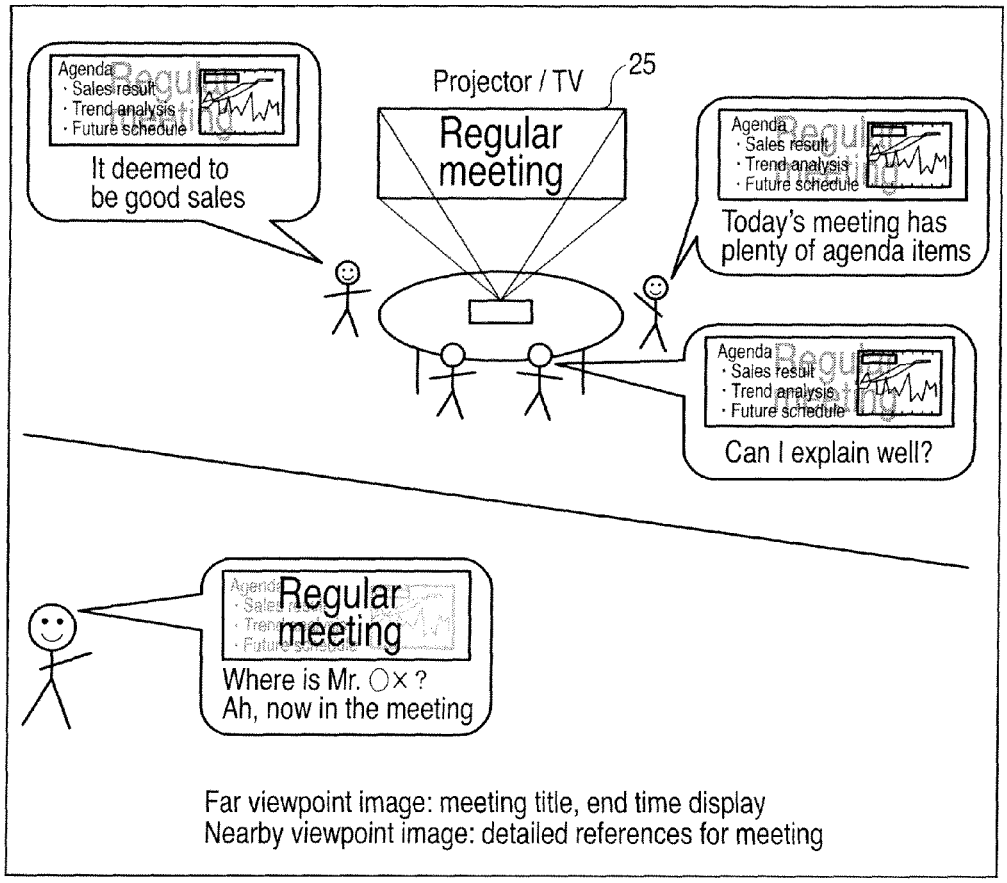
FIG. 6 represents a second application example of the bifocal display device represented in FIG. 1.

FIG. 6 represents a second application example of the bifocal display device. In recent years, open spaces in offices have come to be more often used for meetings. In this example, the bifocal display device is applied to a projector or TV 25 used in such meetings. In this case, distant observers can obtain information telling, for example, what meeting ends at what time (so, the observers who are not join the meeting, can determine whether or not they can cut in the middle of the meeting). As in the first application example, messages for distant and nearby observers can be presented simultaneously. Accordingly, both observers can pay consideration for not interrupting each other's jobs.

In the embodiment described above, when distant and nearby viewpoint images are obtained from the database 20, contours of the far viewpoint image are blurred by the low-pass-filter processing unit 23 and contours of the nearby viewpoint image are emphasized by the high-pass filter processing unit 22, in the course of a bifocal image processing. Further, the distant and nearby viewpoint images are superimposed on each other by the superimposition calculation processing unit 24. This image processing provides distant observers with information of the far viewpoint image by excluding influence from the nearby viewpoint image, and also provides nearby observers with information of the nearby viewpoint image by excluding influence from the far viewpoint image. Accordingly, different items of information content respectively corresponding to different distances to the observers can be displayed simultaneously, without requiring switching of the images.

The present invention is not limited to the embodiment described above but may be variously modified without deviating from the scope of the subject matter of the invention.

The above embodiment has been described with reference to an image processing of displaying distant and nearby viewpoint images superimposed on each other. However, the database 20 may further manage intermediate viewpoint images (or namely intermediate focal-length image) as data files in addition to distant and nearby viewpoint images. In this case, an image processing circuit performs an image processing on an intermediate viewpoint image. In this manner, by further displaying and superimposing still another image which is seen differently depending on the distance from the display 14, distant observers, intermediately distant observers, and nearby observers may be allowed to recognize respectively different items of information content.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A bifocal display device comprising:

a database that manages at least distant and nearby viewpoint images as data files;

an low-pass filter processing unit that obtains a far viewpoint image from the data base, and blurs contours of the far viewpoint image;

an high-pass filter processing unit that obtains a nearby viewpoint image and emphasizes contours of the nearby viewpoint image;

an superimposition processing unit that superimposes the far viewpoint image and nearby viewpoint image processed by the high-pass and low-pass filter processing units on each other; and a display that displays a result of the superimposition processing unit.

2. A bifocal display device of claim 1, further comprising:

a human sensor that detects an observer who has come up close to the display; and a controller that changes a display content of the nearby viewpoint image if the human sensor detects such an observer.

3. The bifocal display device of claim 2, wherein the controller outputs a sound as the display content of the nearby viewpoint image is changed.

4. The bifocal display device of claim 1, wherein the nearby viewpoint image includes one of text and graphic within a size capable of providing a nearby observer with a large quantity of information, and the far viewpoint image is includes one of text and graphic within a larger size than the former size, the larger size being capable of providing a distant observer with a small quantity of information.

5. A bifocal display method comprising:

managing at least distant and nearby viewpoint images as data files;

obtaining a far viewpoint image from the database and blurring contours of the far viewpoint image by a low-pass filter;

obtaining a nearby viewpoint image from the database and emphasizing contours of the nearby viewpoint image by a high-pass filter;

performing an image processing of superimposing the far viewpoint image and the nearby viewpoint image processed by the high-pass and low-pass filters on each other; and displaying a result of the image processing.

6. The bifocal display method of claim 5, further comprising detecting an observer of the nearby viewpoint image to be displayed and changing a display content of the nearby viewpoint image.

7. The bifocal display method of claim 6, further comprising outputting a sound as the display content of the nearby viewpoint image is changed.

8. The bifocal display method of claim 5, wherein the nearby viewpoint image includes one of text and graphic within a size capable of providing a nearby observer with a large quantity of information, and the far viewpoint image includes one of text and graphic within a larger size than the former size, the larger size being capable of providing a distant observer with a small quantity of information.

* * * * *